US007059346B2

(12) United States Patent
Robb et al.

(10) Patent No.: US 7,059,346 B2
(45) Date of Patent: Jun. 13, 2006

(54) LIQUID COLLECTION BASIN CONNECTION ASSEMBLY

(76) Inventors: Dennis Robb, 980 Awald Dr., Annapolis, MD (US) 21403; Katherine K. Flamm, 1504 Ivanhoe Ave., Baltimore, MD (US) 21228; Thomas P. Carter, 6 Megans Ct., Olney, MD (US) 20832

( * ) Notice: Subject to any disclaimer, the term of this patent is extended or adjusted under 35 U.S.C. 154(b) by 314 days.

(21) Appl. No.: 10/661,890

(22) Filed: Sep. 15, 2003

(65) Prior Publication Data

US 2005/0056323 A1 Mar. 17, 2005

(51) Int. Cl.
*F17D 1/00* (2006.01)
*F16L 25/00* (2006.01)

(52) U.S. Cl. ..... 137/571; 285/19; 285/424

(58) Field of Classification Search ..... 137/571; 285/19, 20, 189, 192, 424
See application file for complete search history.

(56) References Cited

U.S. PATENT DOCUMENTS 480,864 A * 8/1892 Ashlin ..... 285/19
565,499 A * 8/1896 Pattison ..... 285/424
2,398,828 A * 4/1946 Gray ..... 137/571
2,566,219 A * 8/1951 Legros ..... 137/571
2,729,938 A * 1/1956 McDowall et al. ..... 285/19
3,608,871 A * 9/1971 Harsanyi et al. ..... 137/571
4,216,796 A * 8/1980 Gastrock ..... 137/571
4,218,079 A * 8/1980 Arnoldt ..... 285/424
5,538,293 A * 7/1996 Kolt ..... 285/424
5,673,947 A * 10/1997 De Waal ..... 285/424
6,491,054 B1 * 12/2002 Small ..... 137/571

* cited by examiner

*Primary Examiner*—John Rivell
(74) *Attorney, Agent, or Firm*—Edward J. Brosius

(57) ABSTRACT

An assembly for connecting two adjacent liquid collection basins is provided. The assembly includes a flume for connecting a first liquid collection basin to a second liquid collection basin. The flume comprises a generally rectangular structure having a top section, bottom section and two side sections, with an inward flange along one side of the flume and an outward flange along an opposite side of the flume. The flume is inserted through an opening in a wall of the first collection basin, through an opening in the wall of the second collection basin and affixed to each wall, in some embodiments with the use of a support frame.

20 Claims, 4 Drawing Sheets

LIQUID COLLECTION BASIN CONNECTION ASSEMBLY

BACKGROUND OF THE INVENTION

The present invention relates to an assembly for connecting two adjacent liquid collection basins and, more particularly, to an assembly comprising a flume that is utilized to connect two adjacent liquid collection basins.

The present invention addresses a need in connecting adjacent liquid collection basins in devices such as cooling towers. Known connection assemblies comprise a flume of a generally rectangular configuration, usually comprised of galvanized sheet metal or stainless steel. The known connection assembly is shown in prior art FIG. 5 wherein front wall 110 of the first liquid collection basin is seen to have opening 112 of a generally rectangular shape. An adjacent liquid collection basin front wall 114 includes a similar generally rectangular opening 116. Connection flume 120 is seen to comprise a generally rectangular assembly having a top section, a bottom section, and two joining side sections. As mentioned above, connection flume 120 is usually comprised of galvanized sheet metal, stainless steel or similar sheet metal. Connection flume 120 is seen to include an inwardly bent flange 122 on one side of connection flume 120 and an inwardly bent flange 124 on the opposite side of connection flume 120. A plurality of bolt holes 132 are present in inward flange 122, and a plurality of bolt holes 136 are present in inward flange 124 of connection flume 120. A plurality of bolt holes 130 are present around opening 116 in side wall 114 of the second liquid collection basin. Similarly, a plurality of bolt holes 134 are present around opening 112 inside wall 110 of the first liquid collection basin.

A sealant 126 is placed around inward flange 122 and inward flange 124. Connection flume 120 must be affixed to sidewall 110 of the first water collection basin and then sidewall 114 of the second liquid collection basin can be moved into abutman with inward flange 122 of connection flume 120. Due to the construction of the liquid collection basins and the flume, this usually requires that the entire liquid collection basin structure to be assembled, usually as part of an entire cooling tower, prior to the movement of the adjacent collection basin side wall 114 into contact with connection flume 120. This is an undesirable requirement. Further, it is difficult to assure that no gaps in sealant 126 are present, and leaks along the interface between inward flange 122 and sidewall 114 and inward flange 124 and sidewall 110 are known to occur.

SUMMARY OF THE INVENTION

Accordingly, it is an object of the present invention to provide an improved assembly for connecting two adjacent liquid collection basins.

It is another object of the present invention to provide an improved connection flume for connecting two adjacent liquid collection basins.

It is another object of the present invention to provide an improved method for connecting two adjacent liquid collection basins, including the use of an improved connection flume.

The present invention provides an assembly for connecting two adjacent liquid collection basins, the first and second liquid collection basins having facing walls with generally rectangular openings therein. A flume for connecting the adjacent liquid collection basins is provided which itself is a generally rectangular structure having a top section, bottom section and two side sections along with an inward flange along one side of the flume and an outward flange along the opposite side of the flume. The connection flume extends through the opening in one of the liquid collection basins into the opening in the other of the liquid collection basins. The connection flume is affixed to each of the adjacent walls of the liquid collection basins utilizing a combination of support frames and connection devices. Sealants are used between the edges of the flume flanges, support frames, and cover plate to assure liquid tight seals between the connection flume and the walls of the liquid collection basis.

This new invention uniquely allows the flume to be installed or replaced after both liquid collection basins are in their respective final positions. Additionally it provides for a robust water tight field seam where the sealing material is positively confined on all edges by a unique flange design. This flume is also designed such that all water will drain freely from the flume.

DESCRIPTION OF THE DRAWINGS

Referring to the drawings.

DETAILED DESCRIPTION OF THE INVENTION

Figure 1:
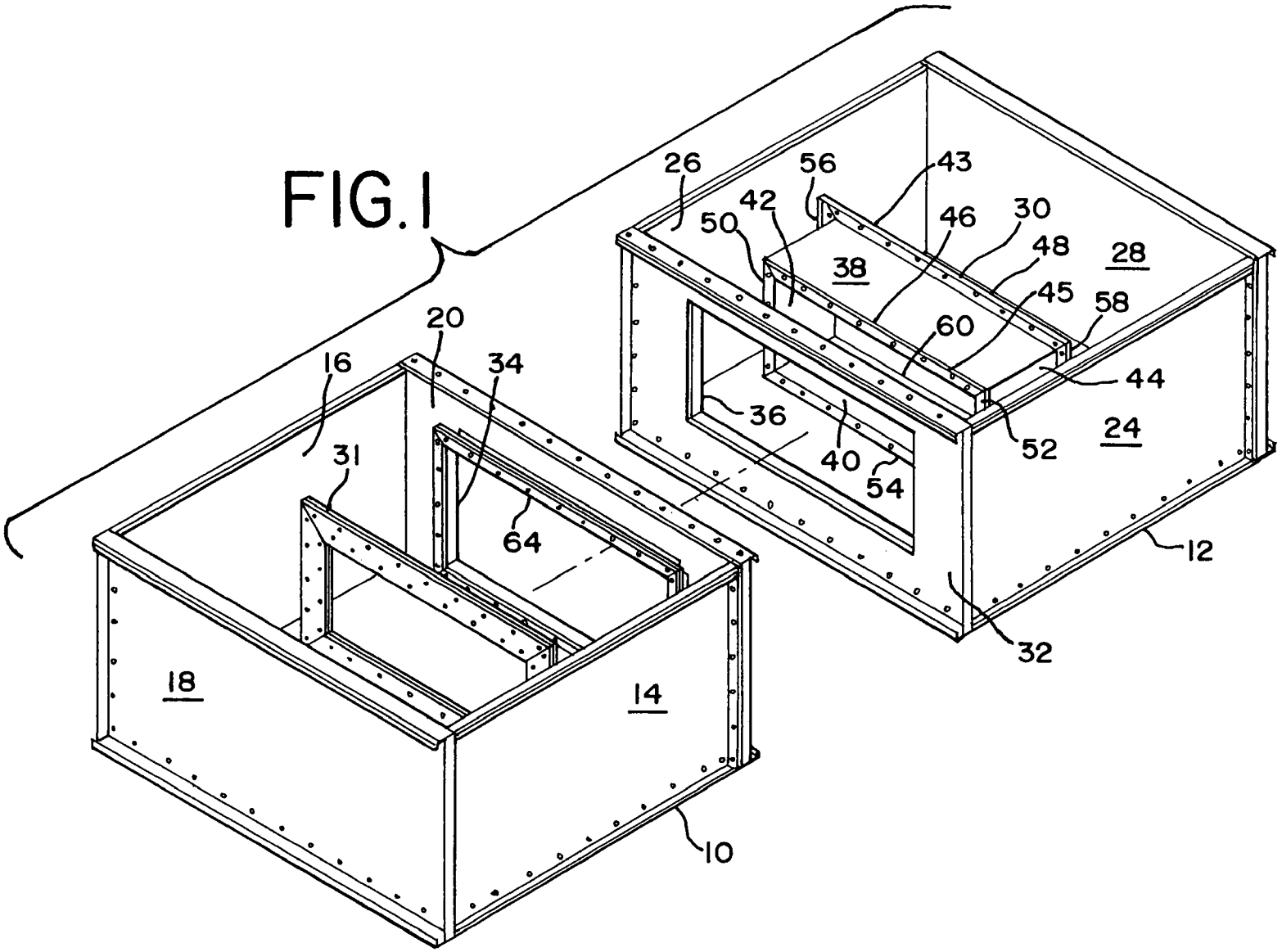
FIG. 1 is an exploded view of two liquid collection basins and connection flume in accordance with the present invention.
Figures 2, 3:
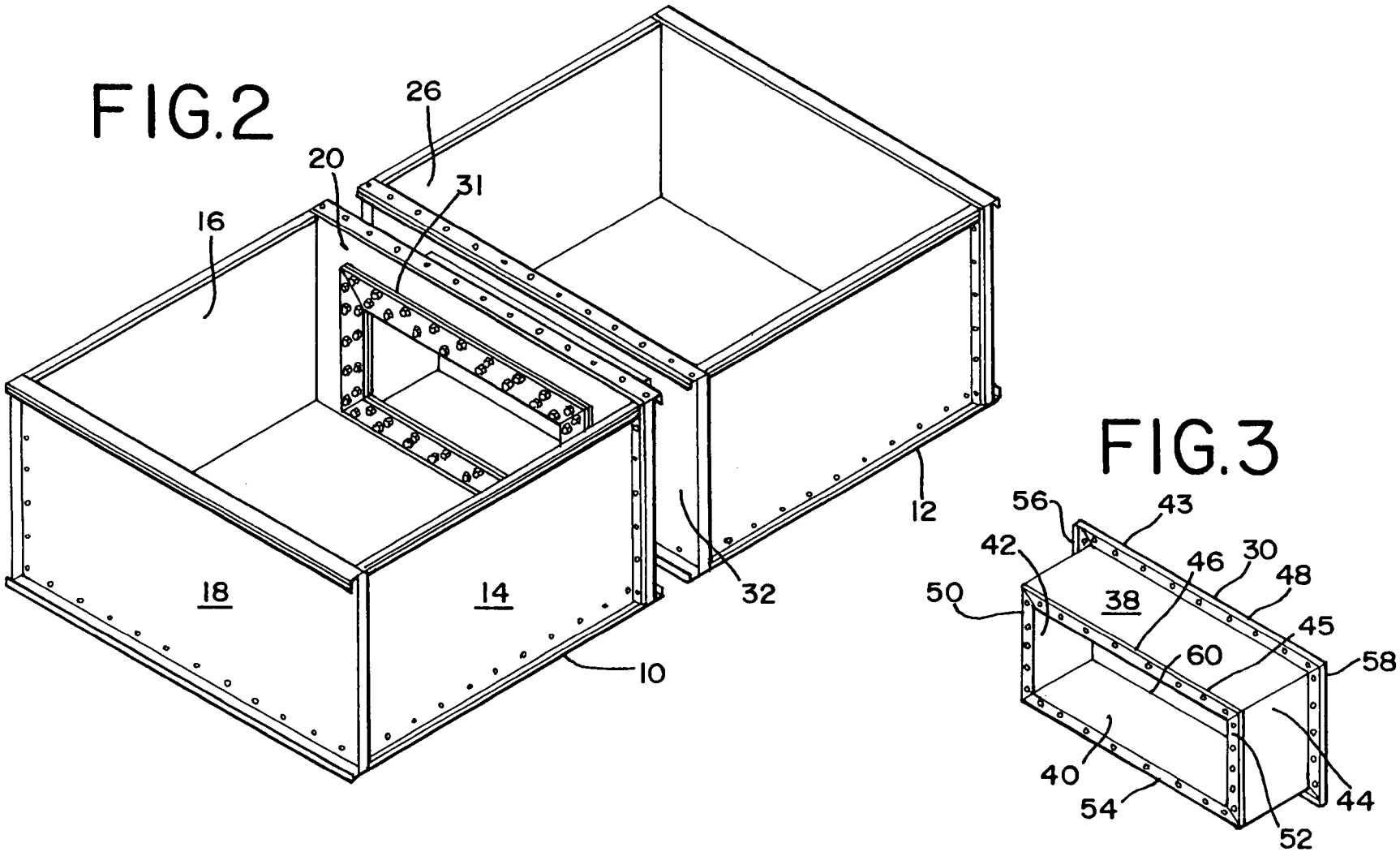
FIG. 2 is a view of an assembled view of two liquid collection basins and connection flume in accordance with the present invention.
FIG. 3 is a perspective view of a connection flume in accordance with the present invention.

Referring now to FIGS. 1, 2, and 3 of the drawings, a first liquid collection basin is shown at 10, and a second liquid collection basin is shown at 12. Liquid collection basin 10 is comprised of side walls 14 and 16, back wall 18, and front wall 20. Liquid collection basin 10 is seen to be a rectangular structure and is usually comprised of galvanized sheet metal, stainless steel, or other similar structural material.

A generally rectangular opening 34 is present in front wall 20. Frame 64 is affixed to the inside of front wall 20 around opening 34. Frame 64 can be comprised of structural components for its top, bottom and sides.

Liquid collection basin 12 is similarly seen to be comprised of sidewalls 24 and 26, back wall 28 and front wall 32. Such walls are typically comprised of galvanized sheet metal, stainless steel, or other similar structural material. Front wall 32 is seen to include a generally rectangular opening 36. A generally rectangular frame 74 is affixed to the inside of front wall 32 around opening 36. Frame 74 can be comprised of structural components for its top, bottom and sides.

Collection flume 30 is seen to be a generally rectangular member, again constructed of galvanized sheet metal, stainless steel, or other similar structural metal. Collection flume 30 is comprised of top section 38, bottom section 40, and side walls 42 and 44. Such walls are all generally rectangular in shape and when assembled, result in the generally rectangular structure of connection flume 30.

Inward flange 46 is seen to be formed along one face of connection flume 30; inward flange 46 is seen to be comprised of inward flange 45 of top section 38, inward flange 54 of bottom section 40, inward flange 50 of side wall 42 and inward flange 52 of side wall 44.

Outward flange 48 extends at the other side of connection flume 30.

Outward flange 48 is seen to be comprised of outward flange 43 of top section 38, outward flange 60 of bottom section 40, outward flange 56 of side wall 42 and outward flange 58 of side wall 44.

Figure 4:
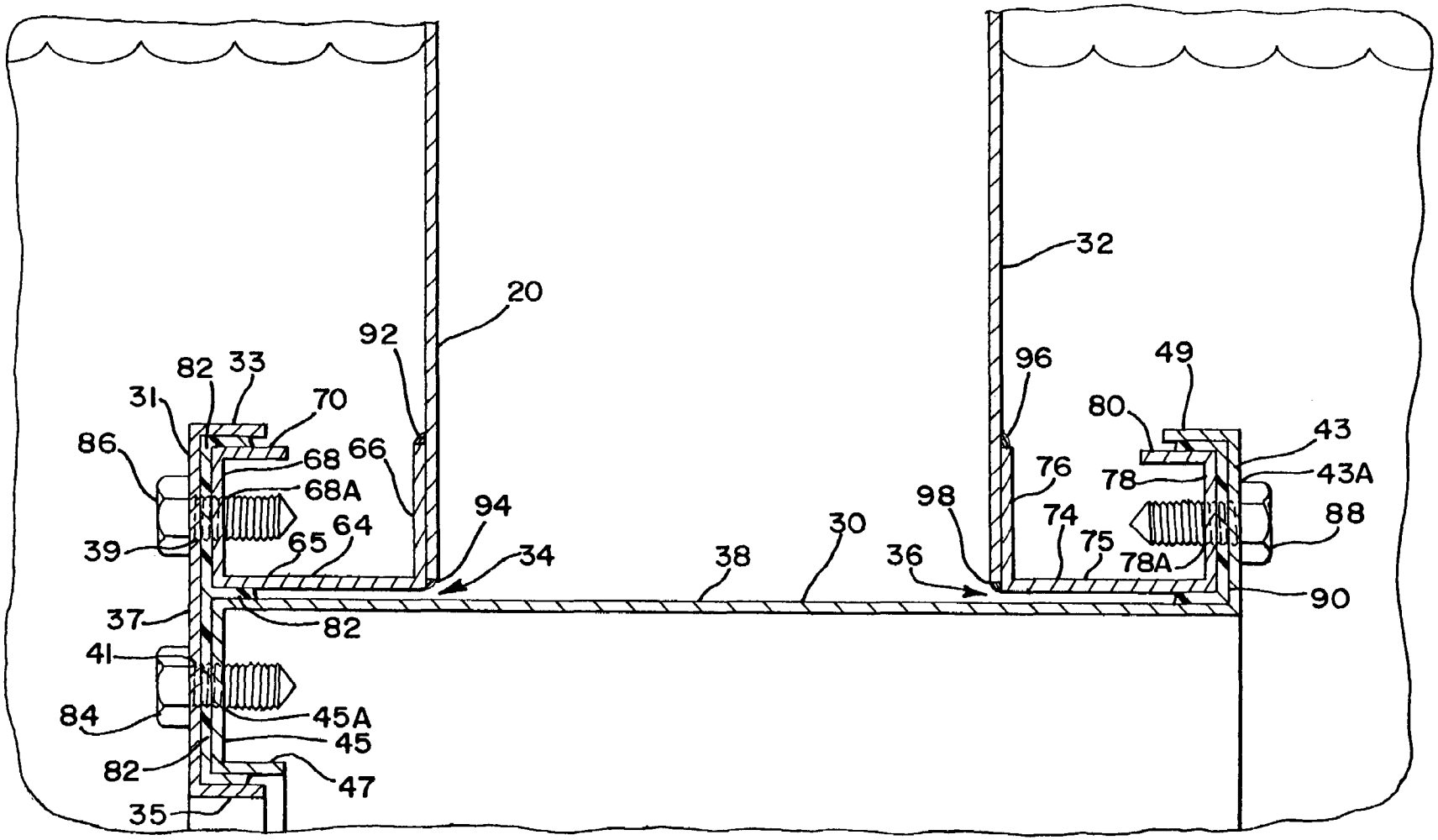
FIG. 4 is a partial cross-sectional view of a top portion of the connection assembly between two liquid collection basins using an embodiment of the liquid of the connection flume in accordance with the present invention.
Figure 5:
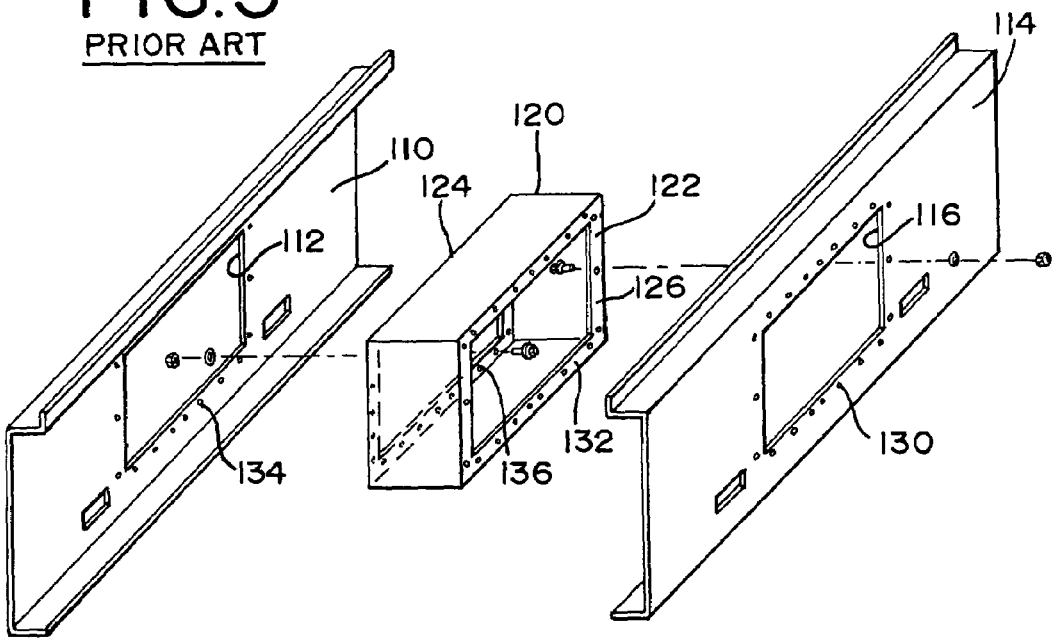
FIG.5 PRIOR ART
FIG. 5 is an exploded view of a prior art liquid collection basin walls, openings and connection flume.

Referring now to FIG. 4 of the drawings, a detailed cross-section of the top of connection flume 30 is shown. One edge of connection flume 30 is seen to comprise inward flange 45 extending downwardly at a perpendicular angle to top section 38. Bottom edge 47 is seen to extend perpendicular to inward flange 45.

Frame 64 is seen to be affixed to an inner surface of front wall 20 adjacent opening 34. Inner frame edge 66 is seen to be tack welded at 92 and continuous welded at 94 to inner surface of front wall 20. Outer frame edge 68 is seen to extend upwardly perpendicular to frame 64 main section 65 and is spaced from inner frame edge 66. Top section 70 is seen to extend perpendicular from outer frame 68.

Cover plate 31 is seen to be a generally channel shaped structure, again of galvanized sheet metal, stainless steel, or other similar structural composition. Cover plate 31 is seen to include side section 37, bottom section 35 extending perpendicular from side section 37 and top section 33 also extending perpendicular from side section 37. Cover plate 31 is seen to include a plurality of outer bolt holes 39 and inner bolt holes 41.

In the assembly of the connection flume inward flange 45, sealant 82 is seen to be present between side sections 37 of cover plate 31 and inward flange 45. Sealant 82 is also seen to extend between bottom section 35 of cover plate 31 and bottom edge 47 of inward flange 45. Further, sealant 82 is seen to be present between main section 65 of frame 64 and top section 38 of connection flume 30. Further, sealant 82 is seen to extend between side edge 37 of cover plate 31 and outer frame edge 68 of frame 64. Sealant 82 also extends between top section 33 of cover plate 31 and top section 70 of frame 64.

A plurality of connection bolts 84 are seen to extend through inner bolt holes 41 of cover plate 31 into a complementary bolt hole opening 45A in inward flange 45 of connection flume 30. A plurality of connection bolts 86 extends through outer bolt holes 39 in cover plate 31 and into a complementary bolt hole opening 68A in outer frame edge 68. It should be understood that connection bolts 84 and 86 could comprise sheet metal screws, could include connection nuts or even other connection means such as rivets and tapped holes.

Referring now to the other side of FIG. 4, front wall 32 of liquid collection basin 12 is shown along with the top portion of opening 36. Frame 74 is tack welded along inner frame edge 76 using tack weld at 98 and continuous weld at 96 to the inner surface of front wall 32. Outer frame edge 78 is seen to extend perpendicular to base portion 75 of frame 74, with outer frame edge 78 being generally parallel to inner frame at 76 and spaced therefrom. Further, top section 80 is seen to extend perpendicular to outer frame edge 78. Outer flange 43 of top section 38 of connection flume 30 is seen to extend perpendicular to top section 38, and further comprises top edge 49 that extends perpendicular to outer flange 43. A plurality of bolt hole openings 43A extends in outer flange 43 with a plurality of complementary bolt hole openings 78A in outer frame edge 78. A plurality of connection bolts 88 extends through bolt hole opening 43A into bolt hole opening 78A to secure outward flange 43 of top section 38 of connection flume 30 to outer frame edge 78. Further, it is seen that sealant 90 extends between base section 75 of frame 74 and top section 38 of connection flume 30. Sealant 90 also extends between outer frame edge 78 and inner surface of outer flange 43. Sealant 90 is also seen to extend between top edge 49 of outward flange 43 and top section 80 of outer frame edge 78.

The structure of connection flume 30 along top section of 38 is duplicated along side sections 42 and 44 with inward flanges 50 and 52 with complementary sections of frame 64 and cover plate 31. Further, a similar connection assembly is provided along inward flange 54 of bottom section 40, complementary with a bottom section of frame 64 and a bottom section of cover plate 31.

Similarly, a connection is also formed along side edge outward flange 56 of side wall 42 and outward flange 58 of side wall 44 of connection flume 30 and complementary side walls of frame 74. Similar connection is formed along outward flange 60 of bottom section 40 of connection flume 30 and a complementary bottom section of frame 74.

Figure 6:
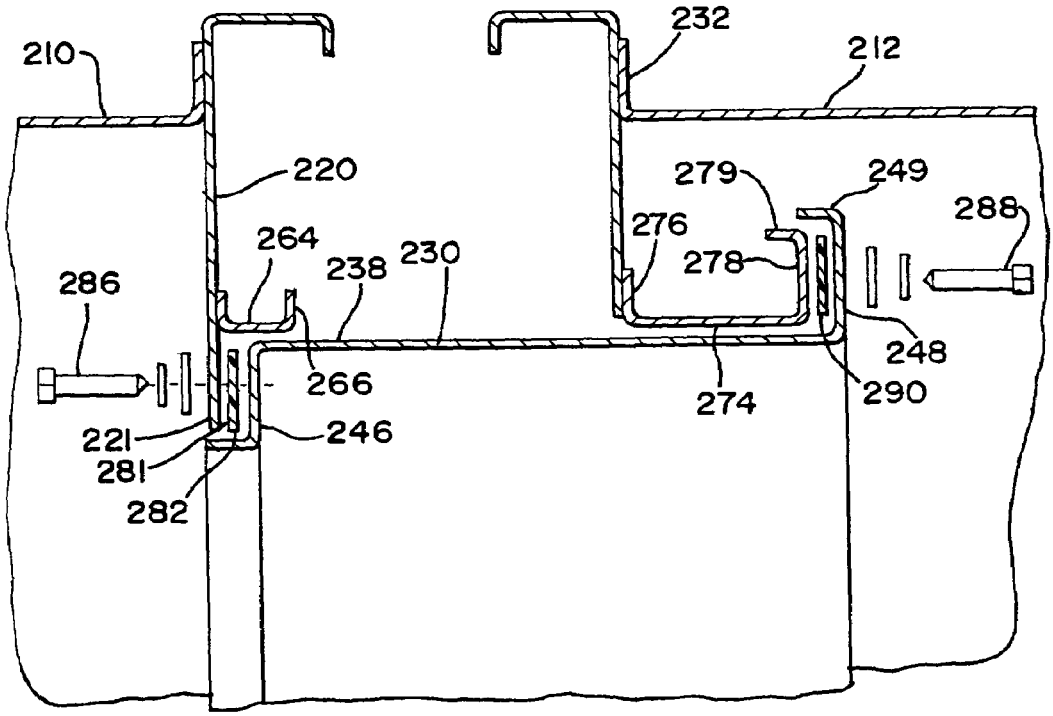
FIG. 6 is a partial cross-sectional view of a top portion of the connection assembly between two liquid collection basins using an alternate embodiment of the liquid of the connection flume in accordance with the present inventions.

Referring now to FIG. 6 of the drawings, another embodiment of the liquid collection basin connection assembly is shown in partial with only the top section of the collection assembly shown. First collection basin 210 is seen to comprise a front wall 220, which could be a separate structure. Second collection basin 212 is seen to include a front wall 232, which also could be a separate structural assembly. Connection flume 230 is again a generally rectangular structure including a top section 238 and an inward flange 246 generally perpendicular to top section 238. An extension 282 protrudes from and is perpendicular to inward flange 246. Frame 264 is seen to be affixed, usually by tack welding generally to front wall 220. Frame 264 is a generally structural steel assembly, also including frame edge 266 extending generally perpendicular to main section of frame 264. Sealant 281 is seen to extend between the lower portion of front wall 220 and inward flange 246. Connection bolt 286 extends through complementary openings in front wall 220 and inward flange 246. Connection bolt 286, is explained above, could also be a sheet metal screw, a bolt nut arrangement, or even a rivet or tapped holes.

Referring now to the other side of collection flume 230, the frame 274 is seen to be affixed along the inner edge 276 to front wall 232. Such connection is usually by means of continuous welding along the connected edges of inner edge 276 and front wall 232. Frame 274 is also seen to comprise outer edge 278 which extends perpendicular to the main section of frame 274, and also includes a top edge 279 extending generally perpendicular to outer edge 278. Connection flume 230 top section 238 is seen to have outward flange 248 extending generally perpendicular to top section 238. Further, top section 249 is seen to extend generally perpendicular to outward flange 248. Sealant 290 is seen to extend between outer edge 278 and of frame 274 and an inner surface of outward flange 248 of connection flume 230. Plurality of connection bolts 288 is provided in extense through complementary openings in outward flange 248 and outer edge 278 to secure connection flume 230 to outer edge 278 of frame 274. Should be understood that connection bolts 288, as stated above, could comprise bolt and nut arrangement, sheet metal screws or even rivets and tapped holes.

Should also be understood that a connection arrangement similar to that described herein for the top section 238 of connection flume 230, would also exist along both sides of connection flume 230 and the sides in the opening front wall 220, and also along the bottom of connection flume 230 and the bottom of the opening in front wall 220.

What is claimed is:

1. An assembly for connecting two adjacent liquid collection basins, the assembly comprising a first liquid collection basin having a front wall with an opening, a second liquid collection basin having a front wall with an opening, a first support frame having an inner edge affixed to the first liquid collection basin front wall around the opening, the first support frame also having an outer edge spaced from the inner edge, a flume for connecting the first liquid collection basin to the second liquid collection basin, the flume comprising a generally rectangular structure having a top section, a bottom section and two side sections, an inward flange along one side of the flume and an outward flange along an opposite side of the flume, a second support frame having an inner edge affixed to the second liquid collection basin front wall around the opening, the second support frame also having an outer edge spaced from the inner edge, a cover plate adjacent the outer edge of the first support frame and the inward flange of the flume a plurality of first connection devices securing the cover plate to the outer edge of the first support frame, a plurality of second connection devices securing the cover plate to the inward flange of the flume, and a plurality of third connection devices securing the outward edge of the flume to the outer edge of the second support frame.

2. The assembly of claim 1 further comprising a sealant between the cover plate and the outer edge of the first support frame.

3. The assembly of claim 1 further comprising a sealant between the cover plate and the inward flange of the flume.

4. The assembly of claim 1 further comprising a sealant between the cover plate and the top section of the flume.

5. The assembly of claim 1 further comprising a sealant between outer edge of the second support frame and the outward flange of the flume.

6. The assembly of claim 1 wherein the first support fame includes a top section extending from the outer edge, the cover plate includes a top section, and a sealant between the top section of the first support frame and the top section of the cover plate.

7. The assembly of claim 1 wherein the inward flange of the flume includes a bottom section, the cover plate includes a bottom section, and a sealant between the bottom section of the cover plate and the bottom section of the inward flange of the flume.

8. The assembly of claim 1 further comprising a sealant between the top section of the flume and the second support frame.

9. The assembly of claim 1 wherein the first support frame is welded to the front wall of the first liquid collection basin around the opening in the front wall.

10. The assembly of claim 1 wherein the second support frame is welded to the front wall of the second liquid collection basin around the opening in the front wall.

11. The assembly of claim 1 wherein the first and second connection devices comprise sheet metal lag bolts.

12. The assembly of claim 1 wherein the first and second connection devices comprise bolts and tapped holes.

13. The assembly of claim 6 wherein the first support frame top section is perpendicular to the outer edge and the cover plate comprises a base section and the top section of the cover plate is perpendicular to the base section.

14. The assembly of claim 7 wherein the inward edge of the flume includes a base section and the bottom section is perpendicular to the base section, and the cover plate comprises a base section and the bottom section is perpendicular to the base section.

15. A method of connection two adjacent liquid collection basins having a front wall with an opening, providing a first collection basin having a front wall with an opening, providing a second collection basin sharing a front wall with an opening, affixing a first support frame around the opening in the first collection basin front wall, the first support frame comprising an inner edge affixed to the front wall of the opening and an outer edge spaced from the inner edge, affixing a second support frame around the opening in the second collection basin front wall, the second support frame comprising an inner edge affixed to the front wall of the opening and an outer edge spaced from the inner edge, inserting a flume so that a portion of the flume extends through the opening in the front wall of the second liquid collection basin and into the opening in the front wall of the first collection basin, the flume comprising a generally rectangular structure having a top section, a bottom section and two side sections, an inward flange along one side of the flume extending onto the opening in the front wall of the first collection basin and an outward flange positioned adjacent the second support frame outer edge, providing a cover plate and affixing the cover plate to the outer edge of the first support frame, affixing the cover plate to the inward flange of the flume, affixing the outward flange of the flume to the outer edge of the second support frame.

16. The method of claim 15 further comprising the steps of providing a sealant between the cover plate and the outer edge of the first support frame, providing a sealant between the cover plate and the inward flange of the flume, and providing a sealant between the outer edge of the second support frame and the outward flange of the flume.

17. The method of claim 15 further comprising the steps of providing the first support frame with a top section extending from the outer edge, providing the cover plate with a top section, and providing a sealant between the top section of the first support frame and the top section of the cover plate.

18. The method of claim 15 further comprising the steps of providing the inward flange of the flume with a bottom section, providing the cover plate with a bottom section, and providing a sealant between the bottom section of the inward flange of the flume and the bottom section of the cover plate.

19. The method of claim 15 further comprising the steps of providing the second support frame with a top section extending from the outer edge, providing the outward flange of the flume with a top section, and providing a sealant between the top section of the second support frame and the top section of the outward flange of the flume.

20. The method of claim 15 further comprising the steps of providing a sealant between the top section of the flume and the first support frame and providing a sealant between the top section of the flume and the second support frame.

* * * * *